United States Patent [19]

Pearson

[11] 4,044,408

[45] Aug. 30, 1977

[54] DEODORIZING ACCESSARY FOR WATER CLOSETS

[76] Inventor: Raymond H. Pearson, 627 Sherwood Drive, Richardson, Tex. 75080

[21] Appl. No.: 727,174

[22] Filed: Sept. 27, 1976

[51] Int. Cl.[2] ..... E03D 9/05; E03D 9/04; A47K 3/22

[52] U.S. Cl. ..... 4/213; 4/216

[58] Field of Search ..... 4/213, 72, 217, 218, 4/211, 214, 215, 216; 220/46 R

[56] References Cited

U.S. PATENT DOCUMENTS

| | | | |
|---|---|---|---|
| 2,297,035 | 9/1942 | Svac | 4/213 |
| 2,449,134 | 9/1948 | Majauskas | 4/213 |
| 2,677,830 | 5/1954 | Allen et al. | 4/213 |
| 2,759,197 | 8/1956 | Majauskas | 4/213 |
| 3,192,539 | 7/1965 | Martz | 4/218 |
| 3,927,429 | 12/1975 | Pearson | 4/213 |

*Primary Examiner*—Henry K. Artis

[57] ABSTRACT

An improvement directed to toilet deodorizers, ventilators and air fresheners of the type which induce odorous air from the toilet bowl via the water tank overflow conduit. Such accessaries are subject to water vapor intrusion from the water tank. A normally-closed air valve means impedes the water vapor intrusion when the accessary is not in use.

5 Claims, 5 Drawing Figures

DEODORIZING ACCESSARY FOR WATER CLOSETS

BRIEF SUMMARY OF THE INVENTION

The more desirable deodorizing accessaries in the art connect into the very humid environment of the water tank. During the summer months the air space sweats profusely, because air conditioning cools the water tank below the temperature of the incoming water. Some deodorizers extend into the attic space, and in winter months these may be cooled considerably, causing them to become very wet and even icy on the inside. Most of the moisture problems within the accessaries develop during the long idle periods when the accessaries are not in use. This has caused the use of more expensive materials and components which can reliably operate under such adverse conditions.

The present invention contemplates the use of air valve means in the intake side of the accessary, resulting in significantly less water condensation within the accessary. In addition to blocking the water vapor intrusion, the valves may in some cases be useful for rapidly removing air suction from the water tank, or to allow air to flow into or from the water tank air space when the toilet bowl is flushed. The valve means may be operated by air flow or pressure, or may be mechanically actuated such as when the air blower is initiated and terminated. In the latter case, air blower braking may not be necessary.

For one practice of the present invention, a valve means comprising two normally-closed reed valves is used to seal the deodorizing accessary from the water tank air space during the idle periods. The air-responsive valves open automatically as required for deodorizing and normal toilet functions. Inasmuch as the area of the air discharge port in the accessary is very much greater than the effective leakage area of the valves, the build-up of water vapor within the accessary is curtailed. Condensation, occuring during the relatively short periods when the accessary is in use, evaporates after the valves close during idle periods. The improved deodorizer is especially suitable for battery operation, since very little power is required to operate the valves.

It is an object of this invention to provide an improved deodorizing accessary which impedes the intrusion of water vapor from the water tank into the accessary.

It is a further object of this invention to provide an improved deodorizing accessary which employs air valve means to impede the intrusion of water vapor from the water tank into the accessary.

It is still a further object of this invention to provide an improved deoderizing accessary which may be manufactured of less costly materials and components, because water vapor condensation has been curtailed.

It is yet another object of this invention to provide an improved deodorizing accessary which is more reliable because moisture build-up has been substantially eliminated.

BRIEF DESCRIPTION OF THE DRAWINGS

With the foregoing objects and features in view, and such other objects and features which may become apparent as this specification proceeds, the invention will be understood from the following description, taken in conjunction with the accompanying drawings, in which like characters of reference are used to designate like parts, and in which.

DESCRIPTION OF THE PREFERRED EMBODIMENTS

Figure 1:
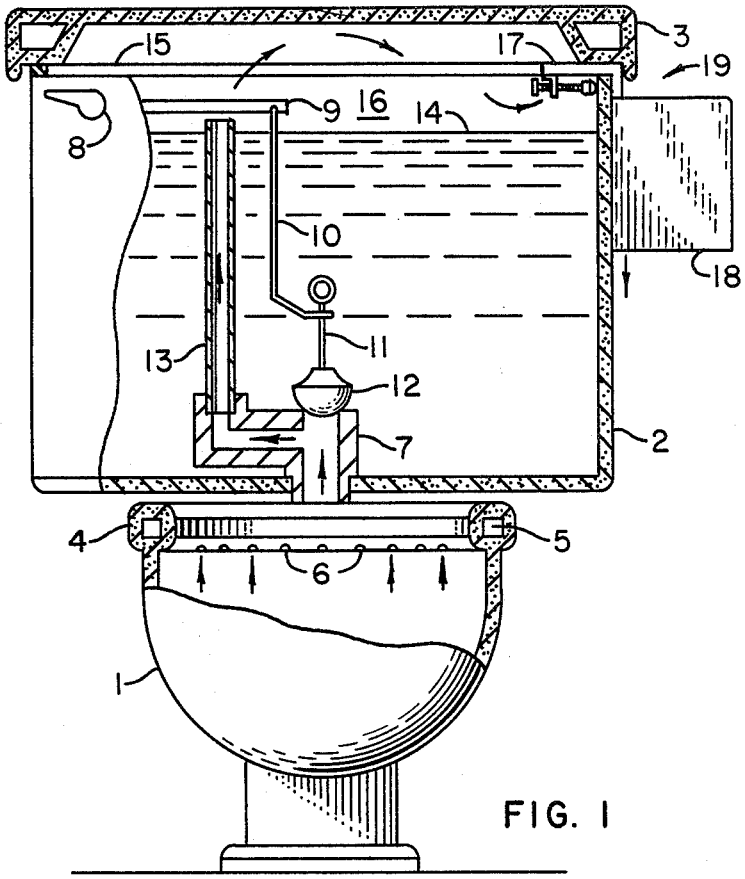
FIG. 1 is a front elevation view, shown partly in section, of the preferred embodiment of the improved accessary installed on a typical water closet.

Referring to the drawings in detail, and particularly to FIG. 1, there is illustrated a typical water closet integrated with the preferred deodorizing accessary. The toilet seat, seat cover, and water connections are not shown, since these are well known and do not appreciably affect the description. The toilet bowl 1, water tank 2 and water tank cover 3 are conventional as shown. The top of the toilet bowl 1 includes a hollow water discharge rim 4, which defines a water discharge channel 5 having water discharge holes 6 around the bottom edge. The water tank 2 is normally seated on the rear of the toilet bowl 1, or integral therewith, and is connected by means of a water discharge conduit 7 to a mating aperture (not shown) in the water discharge rim 4. A portion of the conventional flushing mechanism is shown, including an operating handle 8, lever 9, linkage 10, rod 11, and tank ball 12. When the tank ball 12 is lifted from its rest position, seated upon the water discharge conduit 7, water is discharged from the water tank 2, through the water discharge conduit 7, through the water discharge channel 5, and through the water discharge holes 6 into the toilet bowl 1, flushing the bowl 1. An overflow conduit 13 connects into the water discharge conduit 7 at a point below the tank ball 12, so as to dispense water in excess of the desired water level 14 through the water discharge conduit 7, through the water discharge channel 5, and through the water discharge holes 6 into the toilet bowl 1. It will be understood that the water tank 2 also includes a ballcock (not shown) for the purpose of refilling the water tank 2 to the desired water level 14 after each flushing cycle. Various other configurations of the overflow conduit 13 and tank ball 12 are equally well suited.

Figure 2:
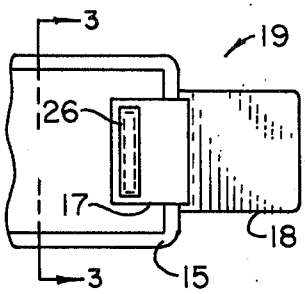
FIG. 2 is a fragmentary top view showing the deodorizing accessary in place on the top rim of the water tank.

A spacer 15 sustains a gap between the upper rim of the water tank 2 and the tank cover 3, and prevents extraneous air intrusion into the water tank air space 16. The spacer 15 has an opening to accommodate a thin, flat air duct 17, as shown in FIG. 2. The housing 18 of the deodorizing accessary 19 depends from the air duct 17, and is ideally cast of ceramic. Clamps 20, comprising brackets 21, screws 22, and bumpers 23, best seen in FIGS. 3 and 4, secure the accessary 19 to the water tank 2.

Figure 3:
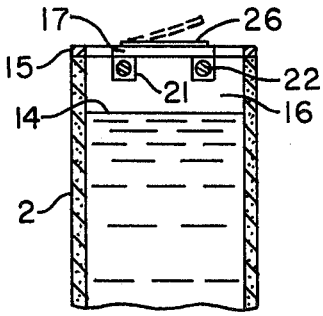
FIG. 3 is a fragmentary elevation view taken along line 3—3 of FIG. 2.
Figure 4:
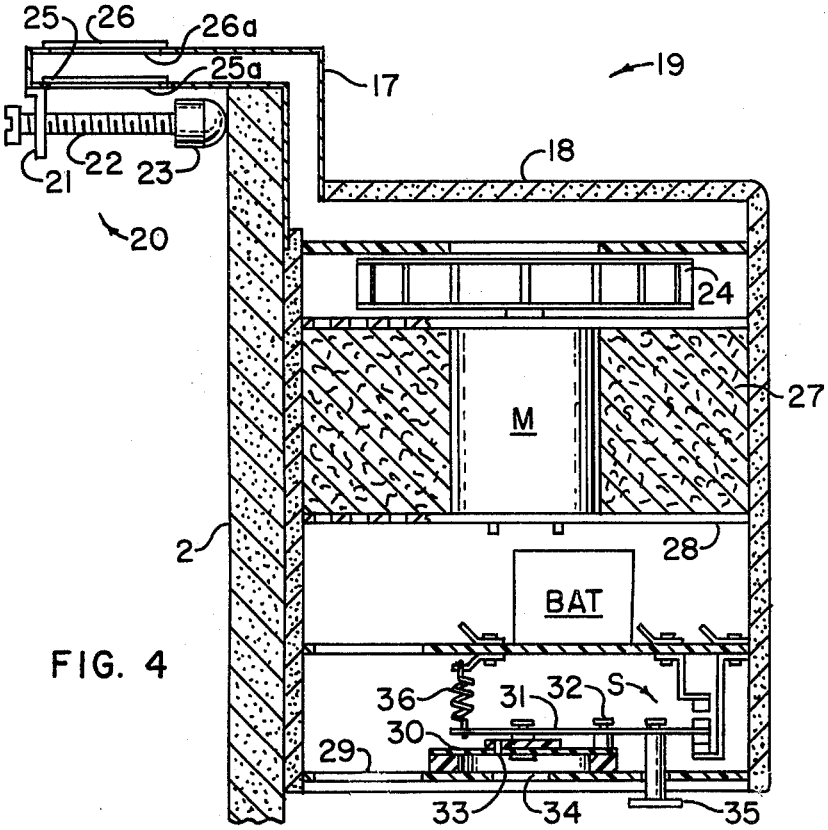
FIG. 4 is an elevation view of the accessary, shown partly in section and on an enlarged scale.

A centrifugal air blower, comprising a blower wheel 24 and permanent magnet electric motor M, FIG. 4, provides air suction to odorous air from the toilet bowl 1, through the water discharge holes 6, through the water discharge channel 5, through the water discharge conduit 7, and through the overflow conduit 13 into the water tank air space 16. The flow of odorous air is represented by arrows, FIG. 1. Two identical normally-closed reed valves 25 and 26 are attached to the air duct 17, as seen in FIGS. 2, 3 and 4. The reed valves 25 and 26, easily made from plastic foil or metal shim, are very light and open on very small pressure differentials. The valves 25 and 26 should be bonded to the air duct 17 at one end of each valve 25 and 26, so as to cover the ports 25*a* and 26*a*. The open position of valve 26, typical of valve 25 also, is depicted by a dashed outline in FIG. 3. The air duct 17 opens into the water tank air space 16 through the ports 25*a* and 26*a*. When the blower is initiated, the flow of odorous air opens the valve 25, allowing the unrestricted flow of odorous air into the air duct 17. The odorous air passes through an activated charcoal filter 27, caged by perforated plates 28, where it is deodorized. The valves 25 and 26 protect the filter 27 from becoming waterlogged during long idle periods. The deodorized air exits the accessary 19 through a discharge port 29, FIG. 4. When the air blower is terminated, the valve 25 closes again. Inasmuch as water vapor leakage through the valves 25 and 26 is very small compared to the exposure of the accessary 19 to fresh air through the discharge port 29, the build-up of moisture inside the accessary 19 is practically eliminated.

Figure 5:
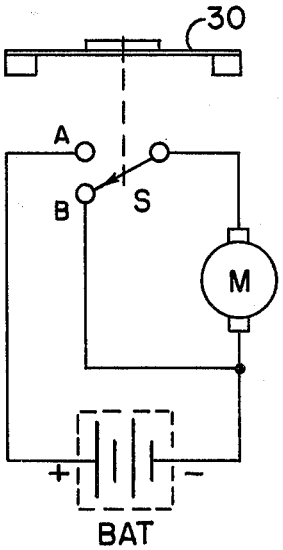
FIG. 5 is a schematic diagram of an electrical circuit suitable for the improved accessary.

A switch S and diaphragm 30, FIGS. 4 and 5, comprise the control system. A battery BAT provides electrical power for the motor M. The switch lever 31 pivots loosely on a fulcrum 32. The lever 31 is loosely riveted to the diaphragm 30. A small hole 33 vents the diaphragm cavity to the discharge pressure of the air blower wheel 24, and a larger hole 34 vents the cavity to atmospheric pressure. To initiate the accessary 19, a button 35, loosely rivited to the lever 31, is actuated, causing the switch S to close to position A, FIG. 5. This of course starts the motor M. The diaphragm 30 is responsive to the discharge pressure of the blower wheel 24, and is displaced downwardly by this pressure, holding the switch S closed to position A. When the toilet bowl 1 is flushed, water floods the overflow conduit 13, retarding the flow of air through it. The discharge pressure of the blower wheel 24 drops at this time, allowing the diaphragm 30 to return to its rest position, because of a small bias spring 36, FIG. 4. This returns the switch S to position B, braking the motor M to a rapid stop. The air blower may also be terminated manually by placing a finger over the large vent hole 34, which causes the pressure on both sides of the diaphragm 30 to equalize through the small vent hole 33, allowing the switch S to return to position B. Therefore, when the toilet bowl 1 is flushed the air blower stops, and the valve 25 closes. Inasmuch as the water level 14 is now falling rapidly, valve 26 opens in response to air flowing back through the accessary 19 into the water tank air space 16. The action of the valve 26 insures a normal rapid flushing cycle. After the bowl 1 is flushed, the water tank 2 begins to refill. At this time the valve 26 closes, and the valve 25 may again open in response to air flowing from the water tank air space 16 as the water tank 2 refills with water. Deodorizers connecting directly into the overflow conduit 13 do not normally require the use of the valve 26, inasmuch as the spacer 15 is not used to seal the water tank air space 16.

The improvement as disclosed may be modified without departing from the principles and scope of the invention, and it is not desired to limit the invention to the exact construction shown and described. The improvement is useful in most all deodorizing accessaries which are placed within, or connect into, the water tank 2.

What is claimed is:

1. A deodorizing accessary for water closet including a toilet bowl, water tank and water tank cover, said water tank including an overflow conduit, whereby water in excess of the desired water level may be dispensed into said toilet bowl, and through which odorous air may be induced from said toilet bowl, said water tank also including a flushing mechanism whereby water may be discharged into said toilet bowl so as to flush said toilet bowl, and an air space above the water level, said accessary comprising air blower means having an inlet communication with said overflow conduit whereby odorous air may be induced from said toilet bowl, control means operable to initiate and terminate the odorous air flow, and air valve means in said inlet communication said air valve means operable to close when said accessary is not in use, retarding the intrusion of water vapor from said water tank into said accessary, said air valve means operable to open so as to pass said odorous air flow when said accessary is in use, said air valve means also operable to open so as to pass air into said water tank air space when said toilet bowl is flushed.

2. The invention as set forth in claim 1, said air valve means also operable to open so as to pass air from said water tank air space when said water tank is filling with water.

3. A deodorizing accessary a water closet including a toilet bowl and a water tank defining an air space above the water level, said water tank including an overflow conduit whereby water in excess of the desired level may overflow into said toilet bowl, and whereby odorous air may be induced from the toilet bowl, a flushing mechanism whereby water may be discharged into said toilet bowl so as to flush the bowl, and a water filling valve means whereby the water tank may be filled with water after the toilet bowl is flushed, said accessary comprising air blower means having an air inlet communication with said overflow conduit, control means operable to initiate and terminate said air blower means whereby the air blower means is operable to induce the flow of odorous air from said toilet bowl through the overflow conduit, and air valve means in said air inlet communication, said air valve means operable to open in response to said flow of odorous air and operable to close in response to the discontinuation of the odorous air flow, so as to retard the intrusion of water into said accessary.

4. The invention as set forth in claim 3, said air valve means also operable to open so as to pass air into said water tank air space when said toilet bowl is flushed.

5. The invention as set forth in claim 3, said air valve means also operable to open so as to pass air from said water tank air space when said water tank is being filled with water.

* * * * *

UNITED STATES PATENT OFFICE

CERTIFICATE OF CORRECTION

Patent No. 4,044,408 Dated August 30, 1977

Inventor(s) Raymond H. Pearson

It is certified that error appears in the above-identified patent and that said Letters Patent are hereby corrected as shown below:

Column 4, line 8, after "for" insert -- a --.

Column 4, line 22, after "communication" insert a comma.

Column 4, line 34, after "accessary" insert -- for --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*